US009248650B2

(12) United States Patent
Muraoka et al.

(10) Patent No.: US 9,248,650 B2
(45) Date of Patent: Feb. 2, 2016

(54) LIQUID EJECTION HEAD WITH PLURALITY OF CHANNELS FOR SUPPLYING LIQUID TO SUPPORT PORT

(71) Applicant: CANON KABUSHIKI KAISHA, Tokyo (JP)

(72) Inventors: Chiaki Muraoka, Kawaguchi (JP); Mikiya Umeyama, Tokyo (JP); Satoshi Oikawa, Yokohama (JP); Takuya Iwano, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/619,351

(22) Filed: Feb. 11, 2015

(65) Prior Publication Data

US 2015/0239243 A1 Aug. 27, 2015

(30) Foreign Application Priority Data

Feb. 25, 2014 (JP) ..... 2014-034146

(51) Int. Cl.

| | |
|---|---|
| ***B41J 2/05*** | (2006.01) |
| ***B41J 2/175*** | (2006.01) |
| ***B41J 2/14*** | (2006.01) |
| ***B41J 2/19*** | (2006.01) |

(52) U.S. Cl.

CPC . *B41J 2/1433* (2013.01); *B41J 2/19* (2013.01)

(58) Field of Classification Search

CPC .... B41J 2/175; B41J 2/17513; B41J 2/17523; B41J 2/14145

USPC ..... 347/65, 66, 67, 85, 86, 87

See application file for complete search history.

(56) References Cited

U.S. PATENT DOCUMENTS

| | | | | |
|---|---|---|---|---|
| 5,220,345 | A * | 6/1993 | Hirosawa | 347/17 |
| 6,062,681 | A * | 5/2000 | Field et al. | 347/65 |
| 6,120,139 | A * | 9/2000 | Childers et al. | 347/92 |
| 6,322,206 | B1 * | 11/2001 | Boyd et al. | 347/85 |
| 7,427,127 | B2 * | 9/2008 | Ando et al. | 347/85 |
| 8,104,865 | B2 * | 1/2012 | Inada | B41J 2/16532 347/20 |

FOREIGN PATENT DOCUMENTS

JP 2010-018027 A 1/2010

* cited by examiner

*Primary Examiner* — Anh T. N. Vo

(74) *Attorney, Agent, or Firm* — Fitzpatrick, Cella, Harper & Scinto

(57) ABSTRACT

A liquid ejection head includes an element substrate and a support member. The element substrate includes an ejection orifice row, and a supply port. The support member includes a first flow path for supplying a liquid from a liquid supply source to the supply port. The first flow path includes a plurality of channels for supplying liquid to the supply port. At least one of the plurality of channels has a shape in which a cross section that intersects with a flow direction Y of the liquid increases from an upstream side to a downstream side with respect to the direction in which the liquid is supplied.

8 Claims, 10 Drawing Sheets

LIQUID EJECTION HEAD WITH PLURALITY OF CHANNELS FOR SUPPLYING LIQUID TO SUPPORT PORT

BACKGROUND OF THE INVENTION

1. Field of the Invention

The present invention relates to a liquid ejection head for ejecting a liquid, and more specifically relates to a liquid ejection head having a ejection orifice row including a plurality of ejection orifices.

2. Description of the Related Art

An example of a liquid ejection head that is to be mounted in a main body of a liquid ejection apparatus is disclosed in Japanese Patent Application Laid-Open No. 2010-18027. In the liquid ejection head disclosed in Japanese Patent Application Laid-Open No. 2010-18027, an element substrate that includes a ejection orifice row constituted by a plurality of ejection orifices is supported by a support member. A flow path is formed inside the support member, and the flow path communicates with a supply port formed in the element substrate. A liquid is supplied to the ejection orifices via the flow path of the support member and the supply port of the element substrate.

In this connection, air bubbles in the flow path of the support member sometimes constitute a problem in the liquid ejection head. The air bubbles are caused by a gas that flows into a liquid receiving portion together with a liquid when filling the liquid into the liquid receiving portion, a gas that is dissolved in the liquid, or air that permeates a constituent member of the liquid ejection head. If air bubbles build up inside the flow path of the support member, the air bubbles hinder the flow of the liquid, whereby an ejection failure occurs.

As a method for suppressing the occurrence of the aforementioned kind of ejection failure, a method has been proposed that periodically sucks liquid from ejection orifices to eject air bubbles from the liquid ejection head together with the liquid. Further, in Japanese Patent Application Laid-Open No. 2010-18027, a configuration is disclosed in which a flow path of a support member is formed in a shape that is suitable for ejecting liquid and air bubbles when sucking the liquid. More specifically, the flow path of the support member is formed in a shape in which a cross section that intersects with a flow direction of a liquid increases from an upstream side to a downstream side with respect to a direction in which the liquid is supplied.

In recent years, there is a demand to lengthen a ejection orifice row for the purpose of ejecting liquid over a wider range. However, a new problem with respect to a liquid ejection head that arises accompanying lengthening of an ejection orifice row has become evident. The new problem will now be described using FIG. 11.

FIG. 11 is a cross-sectional view that schematically illustrates the inner structure of a liquid ejection head disclosed in Japanese Patent Application Laid-Open No. 2010-18027. In a liquid ejection head 1 illustrated in FIG. 11, a plurality of ejection orifices 2 is formed in an element substrate 3. The ejection orifices are aligned in a predetermined direction to form an ejection orifice row 4. In the present specification, the predetermined direction is also referred to as "arrangement direction X".

A supply port 5 is formed in the element substrate 3, and a flow path 7 is formed in a support member 6. Note that, in the present specification, a direction in which liquid flows in the flow path 7 is also referred to as "flow direction Y". The liquid is supplied from outside of the support member 6 to the ejection orifices 2 via the flow path 7 and the supply port 5. A cross section of the flow path 7 that intersects with the flow direction Y increases progressively in the flow direction Y.

If the ejection orifice row 4 has been lengthened in the arrangement direction X, the supply port 5 must also be lengthened in the arrangement direction X. Accompanying lengthening of the supply port 5, it is desirable to enlarge, in the arrangement direction X, a connection port of the flow path 7 that is connected to the supply port 5 (hereunder, the connection port in question is referred to as "outlet 8"). If the outlet 8 is enlarged in the arrangement direction X without changing the size of a connection port of the flow path 7 that is on the opposite side to the outlet 8 (hereunder, the connection port in question is referred to as "inlet 9"), the length of a wall surface 10 of the flow path 7 with respect to the flow direction Y will increase, and furthermore an angle θ with respect to the flow direction Y will also increase.

The present inventors discovered that, as the length of the wall surface 10 of the flow path 7 increases, the air bubbles 11 are liable to stagnate more at ends in the arrangement direction X of the outlet 8.

Thus, it became clear that in the liquid ejection head disclosed in Japanese Patent Application Laid-Open No. 2010-18027 there is the problem that an ejection failure that is caused by the air bubbles 11 is liable to occur in a case where the ejection orifice row 4 is lengthened and the angle θ is enlarged.

SUMMARY OF THE INVENTION

One aspect of the present invention for solving the above described problem is a liquid ejection head that includes an element substrate and a support member. The element substrate includes an ejection orifice row that includes a plurality of ejection orifices, and a supply port for supplying a liquid to the ejection orifices. The support member includes a first flow path for supplying a liquid from a liquid supply source to the supply port. The first flow path includes a plurality of channels that are aligned in an arrangement direction in which the plurality of ejection orifices of the ejection orifice row are aligned. At least one of the plurality of channels has a shape in which a cross section that intersects with a flow direction of a liquid increases from an upstream side to a downstream side with respect to a direction in which the liquid is supplied.

Another aspect of the present invention is a liquid ejection head having: an element substrate including a plurality of elements that generate energy that is utilized for ejecting a liquid, and a supply port for supplying a liquid to the plurality of elements; and a support member including a first face that supports the element substrate; wherein the support member includes a second face that is a rear face of the first face and in which are formed a first and a second opening that are arranged along a direction in which a plurality of the elements are arrayed, a first channel for supplying a liquid from the first opening to the supply port, and a second channel for supplying a liquid from the second opening to the supply port, in which an opening on the first face side of at least one channel among the first channel and the second channel is larger than an opening on the second face side.

Further features of the present invention will become apparent from the following description of exemplary embodiments with reference to the attached drawings.

DESCRIPTION OF THE EMBODIMENTS

Figure 1A:
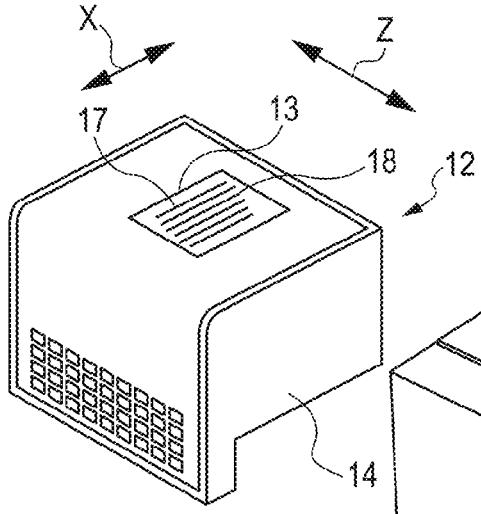
FIG. 1A is a perspective view of a liquid ejection head to which the present invention can be applied.
Figure 1C:
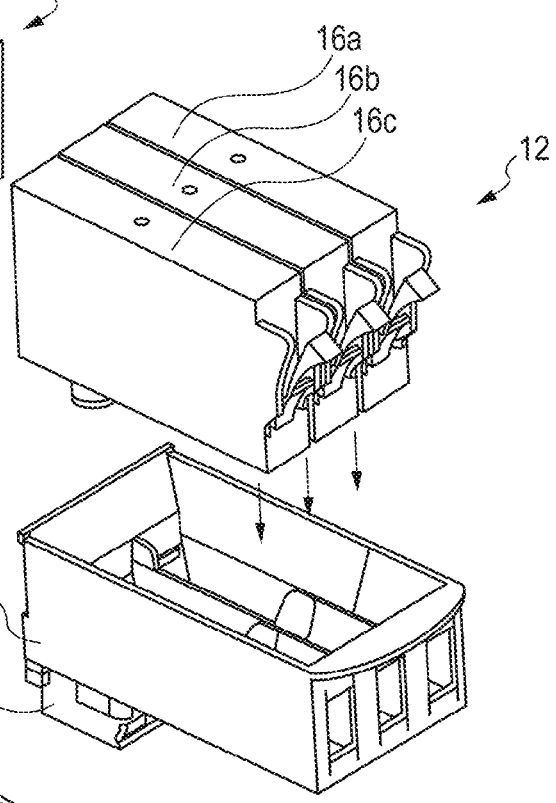
FIG. 1C is a perspective view of the liquid ejection head to which the present invention can be applied.
Figure 1B:
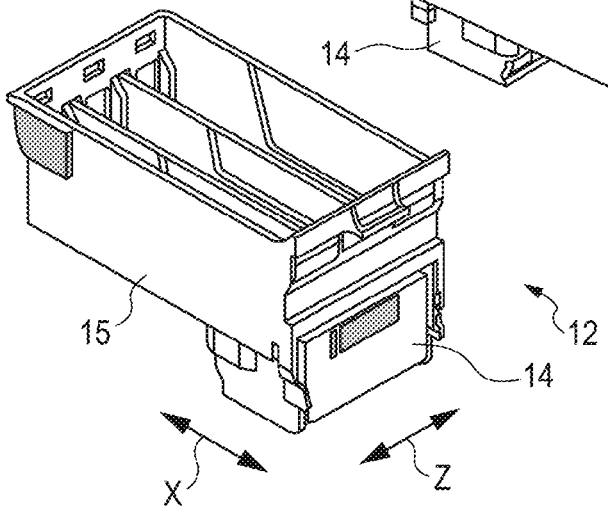
FIG. 1B is a perspective view of the liquid ejection head to which the present invention can be applied.

Embodiments for carrying out the present invention will now be described with reference to the drawings. FIGS. 1A, 1B and 1C are perspective views of a liquid ejection head to which the present invention can be applied. A liquid ejection head 12 illustrated in FIGS. 1A, 1B and 1C is mounted in the main body of a liquid ejection apparatus (not shown). The present invention is not limited to a liquid ejection head that is detachably attachable to the main body of a liquid ejection apparatus, and the present invention can also be applied to a liquid ejection head that is fixed in the main body of a liquid ejection apparatus.

The liquid ejection head 12 includes an element substrate 13, a support member 14 that supports the element substrate 13, and a flow path member 15 that is fixed to the support member 14. The flow path member 15 is formed to be capable of holding cartridges 16*a*, 16*b* and 16*c* as liquid supply sources, and is also referred to as a "cartridge holder". Different types of liquid are contained in the cartridges 16*a*, 16*b* and 16*c*, respectively. For example, cyan ink is contained in the cartridge 16*a*, yellow ink is contained in the cartridge 16*b*, and magenta ink is contained in the cartridge 16*c*. Note that, in the present specification, the cartridges 16*a*, 16*b* and 16*c* may sometimes be referred to as "cartridge" 16 without distinguishing between the respective cartridges.

The element substrate 13 includes a plurality of ejection orifice rows 18 each including a plurality of ejection orifices 17 that are aligned in an arrangement direction X. The plurality of ejection orifice rows 18 are aligned along the arrangement direction X and a direction (also referred to as "scanning direction Z") that intersects with a direction in which liquid is ejected. The cartridges 16*a*, 16*b* and 16*c* communicate with the ejection orifices 17 of the corresponding ejection orifice rows 18, and liquid is supplied to each ejection orifice 17 of the element substrate 13 from the cartridges 16*a*, 16*b* and 16*c*. An energy generating element (not shown) is provided in the vicinity of each ejection orifice 17. Liquid is ejected from the respective ejection orifices 17 as a result of the energy generating element imparting an ejection energy to the liquid.

The liquid ejection head 12 that is mounted in the main body of the liquid ejection apparatus drives the energy generating elements in accordance with a signal from the main body of the liquid ejection apparatus while scanning in the scanning direction Z. By ejecting ink in a desired pattern from the respective ejection orifices 17, a desired image is recorded on a recording medium such as paper.

The main body of the liquid ejection apparatus includes a suction unit (not shown) that sucks out liquid and air bubbles that are inside the liquid ejection head 12 from the ejection orifices 17. By driving the suction unit, foreign matter adhered to the ejection orifices 17 and air bubbles inside the liquid ejection head 12 are removed, and an ejection failure of the liquid ejection head 12 is eliminated. The suction unit also functions as a filling unit that fills liquid into the liquid ejection head 12 when the cartridges 16, 16*b* and 16*c* have been replaced.

Hereunder, embodiments relating to the present invention are described in further detail.

(First Embodiment)

Figure 2:
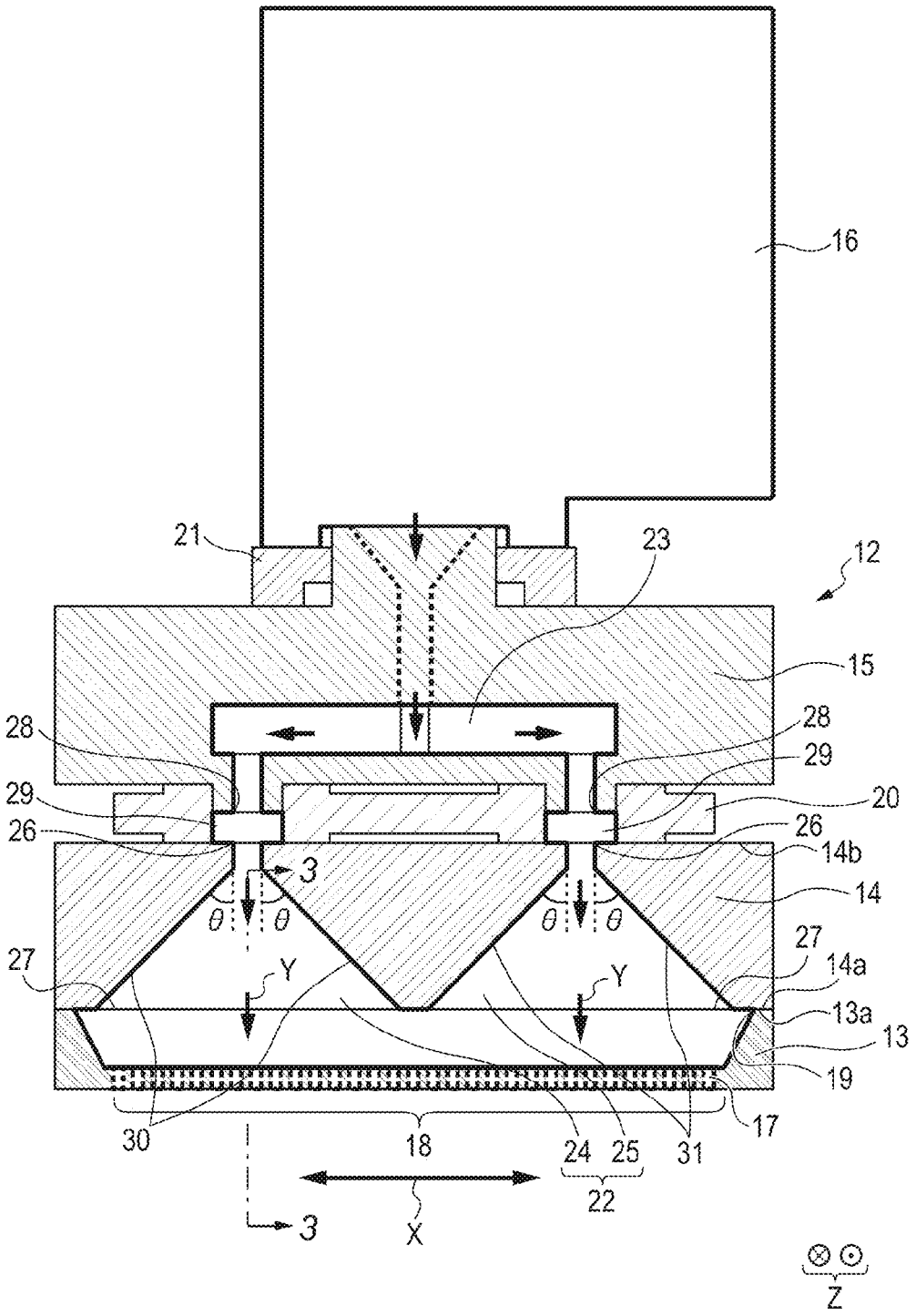
FIG. 2 is a cross-sectional view of a liquid ejection head according to a first embodiment.
Figure 3:
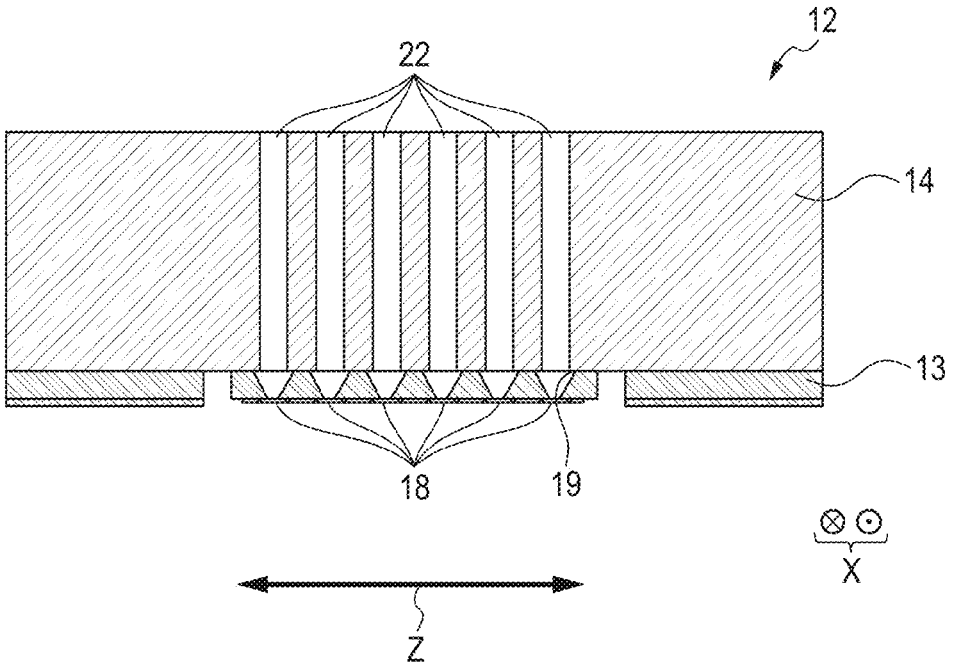
FIG. 3 is a cross-sectional view of the liquid ejection head taken along a line 3-3 illustrated in FIG. 2.

First, a first embodiment of the present invention will be described using FIG. 2 and FIG. 3. FIG. 2 is a cross-sectional view of the liquid ejection head 12 at a plane that intersects with the scanning direction Z (see FIGS. 1A to 1C). FIG. 3 is a cross-sectional view of the liquid ejection head taken along a line 3-3 illustrated in FIG. 2. Note that the flow path member 15 and the cartridge 16 are omitted from the illustration in FIG. 3. Black arrows illustrated in FIG. 2 indicate the flow of liquid that is supplied to the ejection orifices 17 from the cartridge 16.

As illustrated in FIG. 2 and FIG. 3, the element substrate 13 includes a supply port 19 that supplies a liquid to the ejection orifices 17 of the respective ejection orifice rows 18. The supply port 19 is formed in the element substrate 13 in a face thereof that is opposite to the face in which the ejection orifices 17 are formed, and a through hole is formed so as to pass through the element substrate 13 from the supply port 19 to the ejection orifices 17. The support member 14 includes a first face 14*a* that supports a face 13*a* in which the supply port 19 is formed of the element substrate 13. Note that the element substrate 13 is adhered to the first face 14*a* of the support member 14 using an adhesive.

A rubber member (also referred to as a "joint rubber") 20 is disposed on a second face 14*b* of the support member 14. The second face 14*b* is located on the opposite side to the first face 14*a*. The flow path member 15 is fixed to the support member 14 through the rubber member 20. The cartridge 16 is held in the flow path member 15 via a cartridge seal rubber 21.

Liquid contained in the cartridge 16 is supplied to the supply port 19 through the inside of the flow path member 15, rubber member 20 and support member 14. The support member 14 includes a first flow path 22 that supplies liquid to the supply port. The flow path member 15 includes a second flow path 23 that supplies liquid to the first flow path 22 from the cartridge 16. The rubber member 20 functions as a seal member that prevents the outflow of liquid from a gap between the support member 14 and the flow path member 15. The cartridge seal rubber 21 functions as a seal member that prevents the outflow of liquid from a gap between the cartridge 16 and the flow path member 15.

The liquid ejection head 12 also includes a first pressing unit (not shown) that presses the support member 14 towards the flow path member 15 via the rubber member 20, and a second pressing unit (not shown) that presses the cartridge 16 towards the flow path member 15 through the cartridge seal rubber 21. As a result of one member among the support member 14 and the cartridge holder (liquid lead-out member)

15 being pressed against the other member through the rubber member 20, it becomes more difficult for liquid to flow out from a gap between the support member 14 and the flow path member 15. Likewise, as a result of one member among the flow path member 15 and the cartridge 16 being pressed against the other member through the cartridge seal rubber 21, it becomes more difficult for liquid to flow out from a gap between the flow path member 15 and the cartridge 16.

For example, a screw can be used as the first pressing unit. For example, a spring can be used as the second pressing unit. Naturally, the first pressing unit and the second pressing unit are not limited to a screw and a spring.

The first flow path 22 will now be described. The first flow path 22 includes a plurality of channels 24 and 25 that are aligned in the arrangement direction X. The respective channels 24 and 25 extend through the inside of the support member 14 from a connection port 26 formed in the second face 14*b* of the support member 14 to a connection port 27 formed in the first face 14*a* thereof. Note that, in the present specification, to clearly distinguish between the connection port 26 and the connection port 27, in some cases the connection port 26 is referred to as "inlet" and the connection port 27 is referred to as "outlet".

The respective channels 24 and 25 communicate with the supply port 19 through the respective outlets 27. The inlets 26 of the respective channels 24 and 25 are independent from each other, and a plurality of connection ports 28 of the second flow path 23 are formed in the flow path member 15 in correspondence with the positions of the respective inlets 26. A plurality of through holes 29 are formed in the rubber member 20, and the through holes 29 connect the respective inlets 26 and connection ports 28 that correspond to each other.

The channels 24 and 25 each have a shape in which a cross section that intersects with the flow direction Y of the liquid increases from an upstream side to a downstream side with respect to the direction in which the liquid is supplied. In other words, a wall surface 30 of the channel 24 and a wall surface 31 of the channel 25 are inclined with respect to the flow direction Y. Note that the channels 24 and 25 are not limited to a smooth tapered shape. For example, a difference in level of a certain extent that does not inhibit the flow of liquid or the movement of bubbles may be formed in the wall surface 30 and wall surface 31.

In the example illustrated in FIG. 2, the shapes of the respective channels 24 and 25 are substantially symmetrical with respect to an imaginary plane that passes through the center of the ejection orifice row 18 in the arrangement direction X and intersects perpendicularly with the arrangement direction X. The present invention is not limited to this form, and the shapes of the respective channels 24 and 25 may be asymmetrical with respect to the aforementioned imaginary plane.

According to the present embodiment, since the plurality of channels 24 and 25 are aligned along the arrangement direction X, in comparison to a case where the first flow path 22 is constituted by a single channel, an angle θ of the wall surfaces 30 and 31 of each flow path 22 with respect to the flow direction Y decreases. Because the angle θ decreases, even if air bubbles arise inside the liquid ejection head 12, it is easy for the air bubbles to move to the inlet 26 without stagnating at an end in the arrangement direction X of the outlet 27. Since the inlet 26 is further than the outlet 27 from the ejection orifices 17, it is more difficult for air bubbles that moved to the inlet 26 to flow into the ejection orifices 17 in comparison with to air bubbles that have stagnated in the vicinity of the outlet 27, and therefore ejection failures are less liable to occur.

In particular, the present invention is suitable for the liquid ejection head 12 that includes the ejection orifice row 18 that was lengthened. Since the total area of the outlet 27 can be increased without increasing the angle θ, even when the supply port 19 is lengthened accompanying lengthening of the ejection orifice row 18, it is possible to efficiently feed liquid from the second flow path 23 to the supply port 19. Consequently, an adequate amount of liquid is supplied to the ejection orifices 17, and the occurrence of a state in which there is a shortage of liquid inside the liquid ejection head 12 is suppressed.

Air bubbles that have accumulated in the vicinity of the inlet 26 are removed from the ejection orifices 17 using, for example, the suction unit provided in the main body of the liquid ejection apparatus. The present invention is more suitable for a liquid ejection head that is to be mounted in a liquid ejection apparatus that includes a suction unit.

Figure 11:
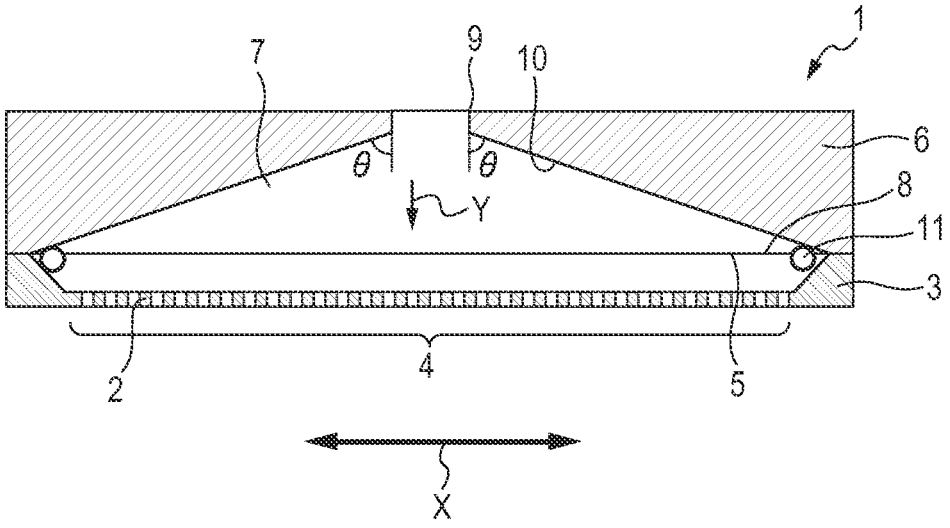
Prior Art FIG. 11
FIG. 11 is a cross-sectional view of a liquid ejection head relating to the present invention.

In the liquid ejection head 1 (see FIG. 11) in which the single flow path 7 is formed in the support member 14 in correspondence with the single supply port 5, if the ejection orifice row 4 is lengthened, air bubbles are liable to stagnate in the vicinity of the outlet 8. Therefore, an ejection failure arises within a relatively short time period after a liquid ejecting operation starts. In order to correct an ejection failure or prevent an ejection failure from occurring, it is necessary to perform liquid suction operations at a relatively high frequency. An increase in the frequency of performing liquid suction operations leads to an increase in the amount of waste ink, and consequently the cost of the liquid increases. Further, an increase in the frequency of liquid suction operations causes an increase in a time period in which liquid is not ejected, and therefore a time period that is required to eject a predetermined amount of liquid increases. Consequently, the benefit of enabling the ejection of liquid over a wide area that is achieved by lengthening the ejection orifice row 4 cannot be sufficiently obtained.

In the liquid ejection head 12 illustrated in FIG. 2 and FIG. 3, since it is difficult for an ejection failure to arise even if the ejection orifice row 18 is lengthened, there is no necessity to increase the frequency of liquid suction operations. Accordingly, the benefit of enabling the ejection of liquid over a wide area that is achieved by lengthening the ejection orifice row 18 is sufficiently obtained. The interval between liquid suction operations can be shorter than a period in which air bubbles that have accumulated in the vicinity of the inlet 26 grow to a size that is large enough to cause an ejection failure.

The present invention is also suitable for a thermal-type liquid ejection head that heats liquid and ejects the liquid. A liquid ejection head that uses a heater as an energy generating element may be mentioned as an example of a thermal-type liquid ejection head. In the liquid ejection head 12 of a thermal type, the number of heaters increases accompanying lengthening of the ejection orifice row 18. Consequently, the amount of generated heat of the element substrate 13 increases, and thus the temperature of liquid inside the liquid ejection head 12 is liable to rise and gas that was dissolved in the liquid is liable to form air bubbles. By utilizing the present invention in a thermal-type liquid ejection head, movement of air bubbles to the inlet 26 is facilitated. As a result, an inflow of air bubbles to the ejection orifices 17 is suppressed, and the occurrence of ejection failures can be suppressed.

In addition, according to the liquid ejection head 12 of the present invention, since it is not necessary to increase the thickness (dimension in the flow direction Y) of the support member 14, an increase in the volume of the flow path 23 that is formed in the support member 14 can be suppressed. Since a shape that facilitates the stagnation of liquid is not formed from the inlet 26 to the outlet 27, it is difficult for an unfilled region to be formed in the flow path 23 when filling liquid into the flow path 23. Consequently, the amount of waste ink can be reduced when filling the flow path 23 with liquid.

As an example of specific dimensions, the length (dimension in the arrangement direction X) of the ejection orifice row 18 can be between 1 and 2 inches, the thickness (dimension in the flow direction Y) of the support member 14 can be between 3 and 5 mm, and the thickness of the element substrate 13 can be, for example, between 0.5 and 1.0 mm. Naturally, the respective dimensions of the liquid ejection head 12 according to the present invention are not limited to these dimensions.

In addition, by making the inlets 26 of the respective channels 24 and 25 mutually independent, the second face 14*b* remains between adjacent inlets 26, and blocking up of a gap between the support member 14 and the flow path member 15 with the rubber member 20 is facilitated. As a result, it is difficult for liquid to leak from the gap, and the reliability of the liquid ejection head 12 is enhanced. Fixing using a pressing unit such as a screw is simple in comparison to fixing using an adhesive. Accordingly, the support member 14 can be fixed to the flow path member 15 for a lower cost, and it is thus possible to suppress an increase in the manufacturing cost of the liquid ejection head 12.

(Second Embodiment)

Figure 4:
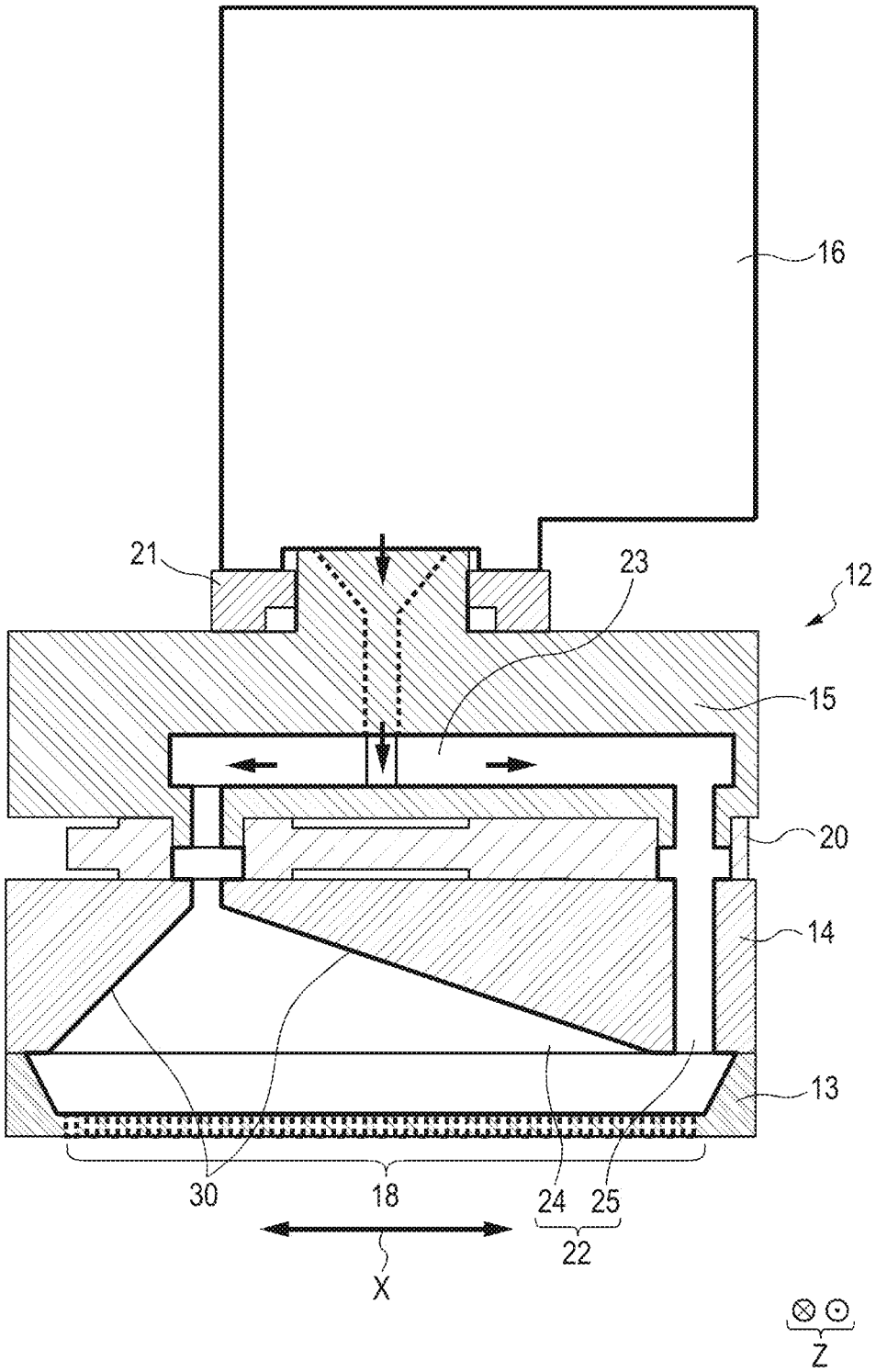
FIG. 4 is a cross-sectional view of a liquid ejection head according to a second embodiment.

Next, a second embodiment of the present invention will be described using FIG. 4. FIG. 4 is a cross-sectional view of the liquid ejection head 12 at a plane that intersects with the scanning direction Z (see FIGS. 1A to 1C). Black arrows illustrated in FIG. 4 indicate the flow of a liquid that is supplied from the cartridge 16 to the ejection orifices 17. Hereunder, portions that are different to the structure of the first embodiment will be described in detail, and portions regarding which there is no particular description hereunder are taken to be in accordance with the structure of the first embodiment.

As illustrated in FIG. 4, in the liquid ejection head 12 according to the present embodiment, the channel 24 among the plurality of channels 24 and 25 has a shape in which a cross section that intersects with the flow direction Y of the liquid increases from an upstream side to a downstream side with respect to the direction in which the liquid is supplied. The other channel 25 among the plurality of channels 24 and 25 has a shape in which a cross section that intersects with the flow direction Y of the liquid is constant from the upstream side to the downstream side with respect to the direction in which the liquid is supplied. Thus, in the present invention at least one of the plurality of channels 24 and 25 can have a shape in which a cross section that intersects with the flow direction Y of the liquid increases from an upstream side to a downstream side with respect to the direction in which the liquid is supplied.

(Third Embodiment)

Figure 5:
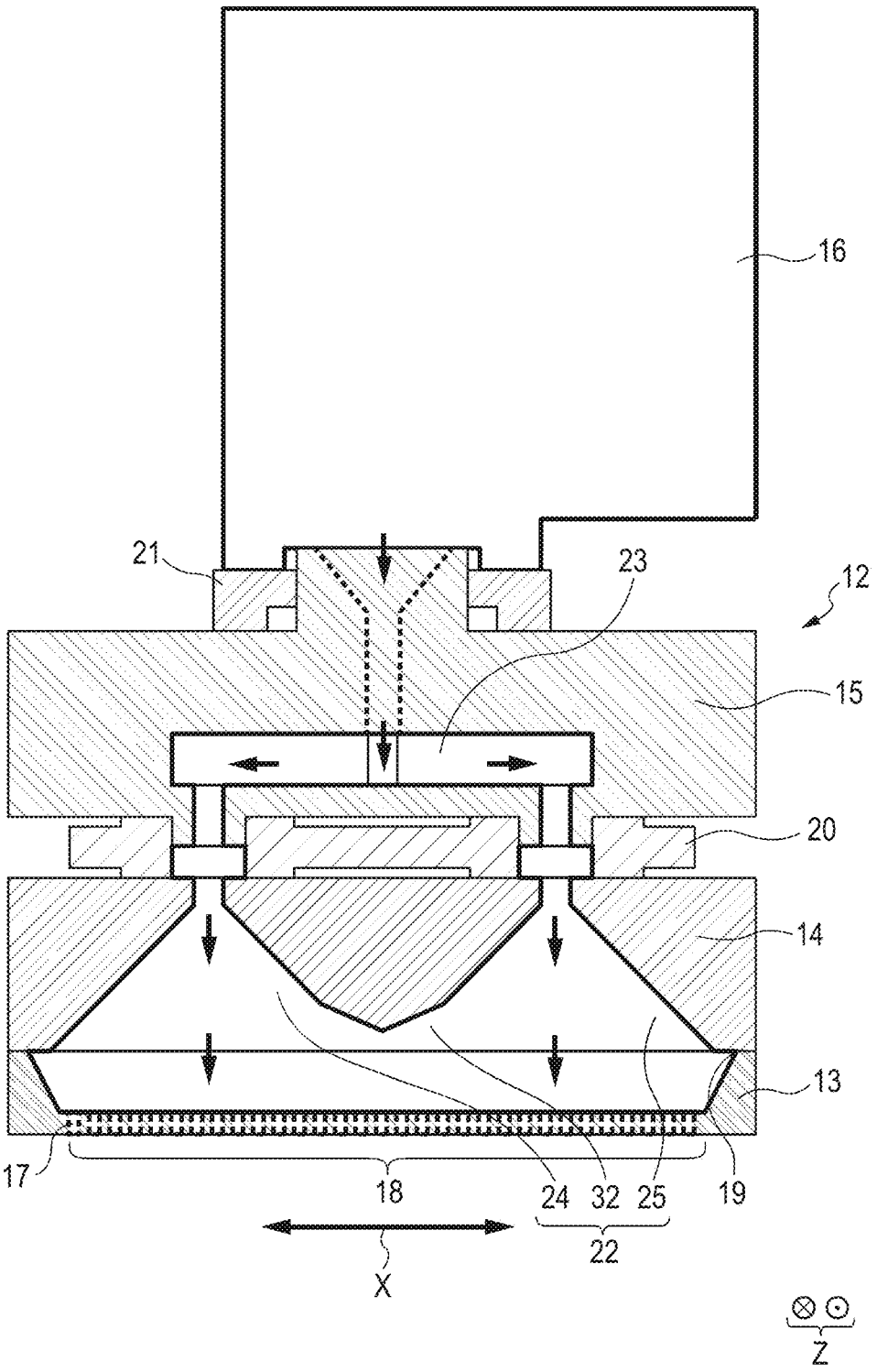
FIG. 5 is a cross-sectional view of a liquid ejection head according to a third embodiment.

Next, a third embodiment of the present invention will be described using FIG. 5. FIG. 5 is a cross-sectional view of the liquid ejection head 12 at a plane that intersects with the scanning direction Z (see FIGS. 1A to 1C). Black arrows illustrated in FIG. 5 indicate the flow of a liquid that is supplied from the cartridge 16 to the ejection orifices 17. Hereunder, portions that are different to the structure of the first embodiment will be described in detail, and portions regarding which there is no particular description hereunder are taken to be in accordance with the structure of the first embodiment.

As illustrated in FIG. 5, the first flow path 22 includes a common channel 32 that is formed in the support member 14 and that allows the plurality of channels 24 and 25 to communicate with each other. The common channel 32 also communicates with the supply port 19. In other words, the channels 24 and 25 are made common by the common channel 32 immediately before communicating with the supply port 19 of the element substrate 13. According to the present embodiment, liquid can move between the plurality of channels 24 and 25, and thus feeding of liquid to the supply port 19 is facilitated.

(Fourth Embodiment)

Figure 6:
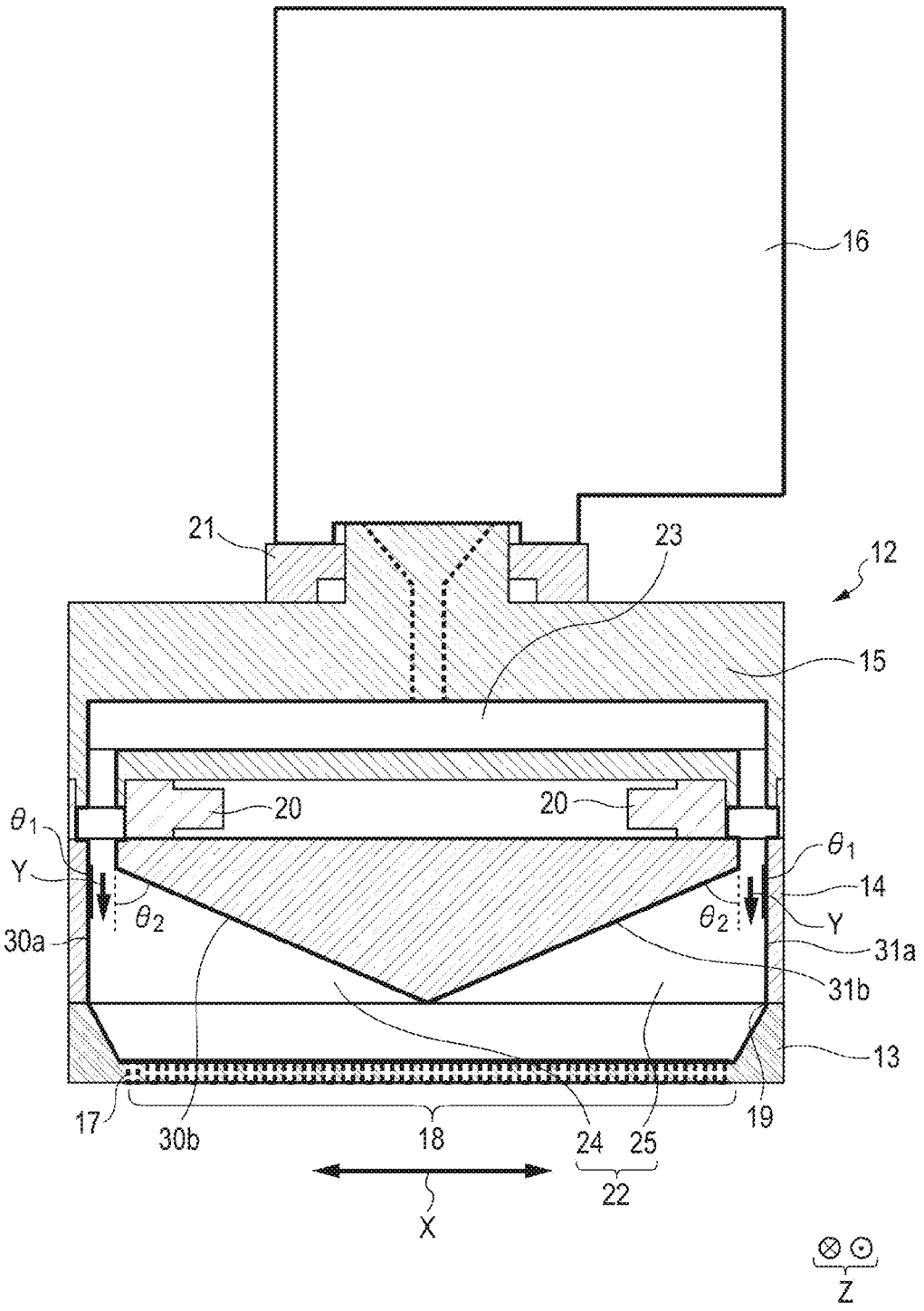
FIG. 6 is a cross-sectional view of the liquid ejection head according to the third embodiment.

Next, a fourth embodiment of the present invention will be described using FIG. 6. FIG. 6 is a cross-sectional view of the liquid ejection head 12 at a plane that intersects with the scanning direction Z (see FIGS. 1A to 1C). Black arrows illustrated in FIG. 6 indicate the flow of a liquid that is supplied from the cartridge 16 to the ejection orifices 17. Hereunder, portions that are different to the structure of the first embodiment will be described in detail, and portions regarding which there is no particular description hereunder are taken to be in accordance with the structure of the first embodiment.

As illustrated in FIG. 6, wall surfaces 30*a* and 30*b* of the channel 24 that face each other in the arrangement direction X are inclined at different angles with respect to the flow direction Y. More specifically, when an angle formed between the wall surface 30*a* that is located at the end side of the ejection orifice row 18 and the flow direction Y is taken as a first angle $\theta_1$, and an angle formed between the wall surface 30*b* that is located at a center side of the ejection orifice row 18 and the flow direction Y is taken as a second angle $\theta_2$, the first angle $\theta_1$ is smaller than the second angle $\theta_2$. According to the present embodiment, it is possible to increase the effect that guides air bubbles that are liable to stagnate at the end sides of the ejection orifice row 18 to the inlet 26. As a result, it is difficult for air bubbles to flow into the ejection orifices 17, and it becomes more difficult for ejection failures to occur.

Note that, although in the example illustrated in FIG. 6 the first angle $\theta_1$ is also smaller than the second angle $\theta_2$ in the channel 25, the first angle $\theta_1$ may be the same as the second angle $\theta_2$ in the channel 25. The first angle $\theta_1$ can be smaller than the second angle $\theta_2$ in at least one channel among the plurality of channels 24 and 25.

Three embodiments of the present invention have been described above. In the embodiments described above, for each single ejection orifice row 18, two channels 24 and 25 are formed in the support member 14. However, according to the present invention, for each single ejection orifice row 18, three or more channels may be formed in the support member 14. Furthermore, naturally the present invention is also applicable to a line head-type liquid ejection head in which a plurality of the ejection orifice rows 18 are aligned in the arrangement direction X.

Examples of configurations that attempt to solve the above described problem utilizing means that are different from the present invention are described hereunder.

COMPARATIVE EXAMPLE 1

Figure 7:
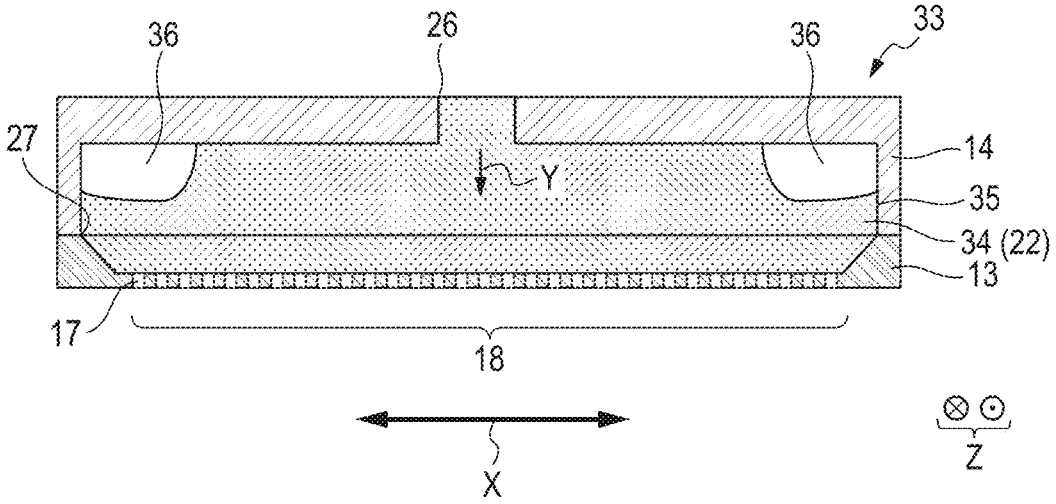
FIG. 7 is a cross-sectional view of a liquid ejection head according to Comparative Example 1.

FIG. 7 is a cross-sectional view of a liquid ejection head according to Comparative Example 1 at a plane that intersects with the scanning direction Z (see FIGS. 1A to 1C). Note that the flow path member 15 and the cartridge 16 are omitted from the illustration in FIG. 7. In a liquid ejection head 33 illustrated in FIG. 7, the first flow path 22 includes a single channel 34 for a single ejection port row 18. A cross section that intersects with the flow direction Y of the channel 34 is the same size as the inlet 26 from the position of the inlet 26 until a position that is a predetermined distance further than the position of the inlet 26 in the flow direction Y, and at the position that is a predetermined distance further than the position of the inlet 26 the cross section changes to a size that is the same as the size of the outlet 27. In other words, a wall surface 35 of the channel 34 is parallel to the flow direction Y. In the liquid ejection head 33 according to Comparative Example 1, because the wall surface 35 of the channel 34 is parallel to the flow direction Y, it is difficult for air bubbles to stagnate at the outlet 27.

However, in the liquid ejection head 33 according to Comparative Example 1, it is difficult for the first flow path 22 to be filled with liquid. More specifically, when liquid is being filled into the first flow path 22, unfilled regions 36 are liable to be formed in the first flow path 22. The unfilled regions 36 become large air bubbles at the time of a liquid ejecting operation, and ride on the flow of liquid that arises in the first flow path 22 and move to the supply port 19. When the air bubbles block up the supply port 19, the supply of liquid to the ejection orifices 17 is obstructed and a ejection failure occurs. If a long time is taken to perform a liquid filling operation in order to ensure unfilled regions 36 are not formed in the first flow path 22, the amount of waste ink will increase.

COMPARATIVE EXAMPLE 2

Figure 8:
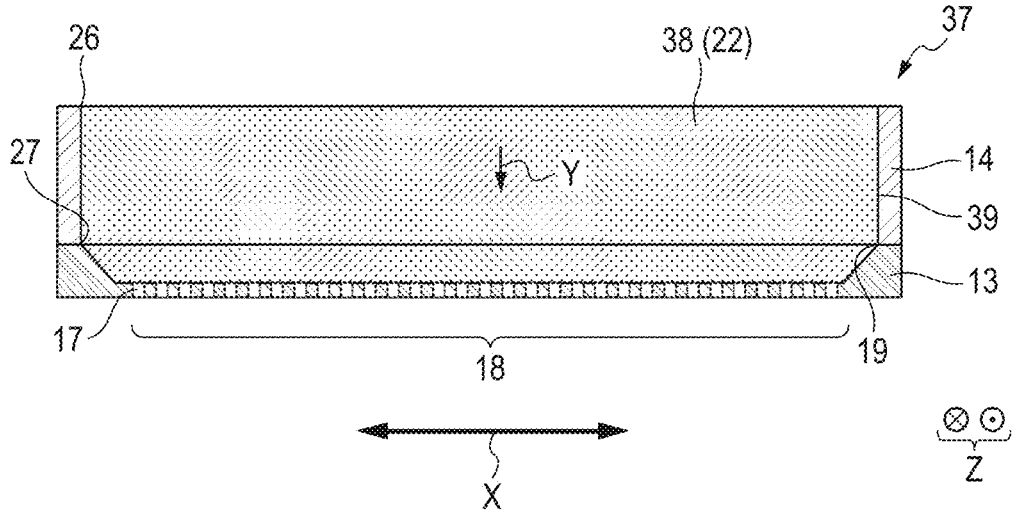
FIG. 8 is a cross-sectional view of a liquid ejection head according to Comparative Example 2.

FIG. 8 is a cross-sectional view of a liquid ejection head according to Comparative Example 2 at a plane that intersects with the scanning direction Z (see FIGS. 1A to 1C). Note that the flow path member 15 and the cartridge 16 are omitted from the illustration in FIG. 8. In a liquid ejection head 37 illustrated in FIG. 8, the first flow path 22 includes a single channel 38 for a single ejection orifice row 18. The inlet 26 of the channel 38 is made the same size as the outlet 27 so as to prevent the formation of unfilled regions 36 that are a problem in Comparative Example 1 (see FIG. 7). In other words, the channel 38 has a shape in which a cross section that intersects with the flow direction Y of the liquid is constant from the upstream side to the downstream side with respect to the direction in which the liquid is supplied, and a wall surface 39 of the channel 38 is parallel to the flow direction Y.

In the liquid ejection head 37 according to the present comparative example, since the wall surface 39 of the channel 38 is parallel to the flow direction Y, it is difficult for air bubbles to stagnate at the outlet 27. Further, since the cross section that intersects with the flow direction Y of the channel 38 is constant with respect to the flow direction Y, it is easy for the channel 38 to be filled with liquid.

However, in the liquid ejection head 37 according to Comparative Example 2, the inlet 26 is relatively large and it is therefore difficult to block up the gap between the support member 14 and the flow path member 15 (see FIG. 2) with the rubber member 20 (see FIG. 2).

In order to manufacture the liquid ejection head 37 at a low cost, it is desirable to fix the flow path member 15 (see FIG. 2) to the support member 14 through the rubber member 20 (see FIG. 2). However, in the liquid ejection head 37 according to Comparative Example 2, the inlet 26 extends in the arrangement direction X. Accordingly, a portion of the rubber member 20 that is positioned between adjacent inlets 26 with respect to the scanning direction Z will have a long and narrow shape. Consequently, the rubber member 20 will not be able to adequately seal an area between adjacent inlets 26 in the scanning direction Z.

Although an area between adjacent inlets 26 can be adequately sealed with the rubber member 20 (see FIG. 2) if the distance between the adjacent inlets 26 in the scanning direction Z is increased, in such case the size of the support member 14 and the element substrate 13 will increase. As a result, the manufacturing cost of the liquid ejection head 37 will significantly increase, which is not desirable.

In the case of fixing the flow path member 15 (see FIG. 2) to the support member 14 using an adhesive, it is necessary to perform a process of coating an adhesive on at least one of the flow path member 15 and the support member 14, and therefore the manufacturing cost of the liquid ejection head 37 will increase. Furthermore, if an interval between adjacent inlets 26 in the scanning direction Z is narrow, a region on which the adhesive is coated will be a long and narrow shape, and it will be difficult to apply an adequate amount of adhesive. Therefore, even when the flow path member 15 is fixed to the support member 14 using an adhesive, a failure whereby a leaking channel arises locally between the inlets 26 is easily caused.

COMPARATIVE EXAMPLE 3

Figure 9:
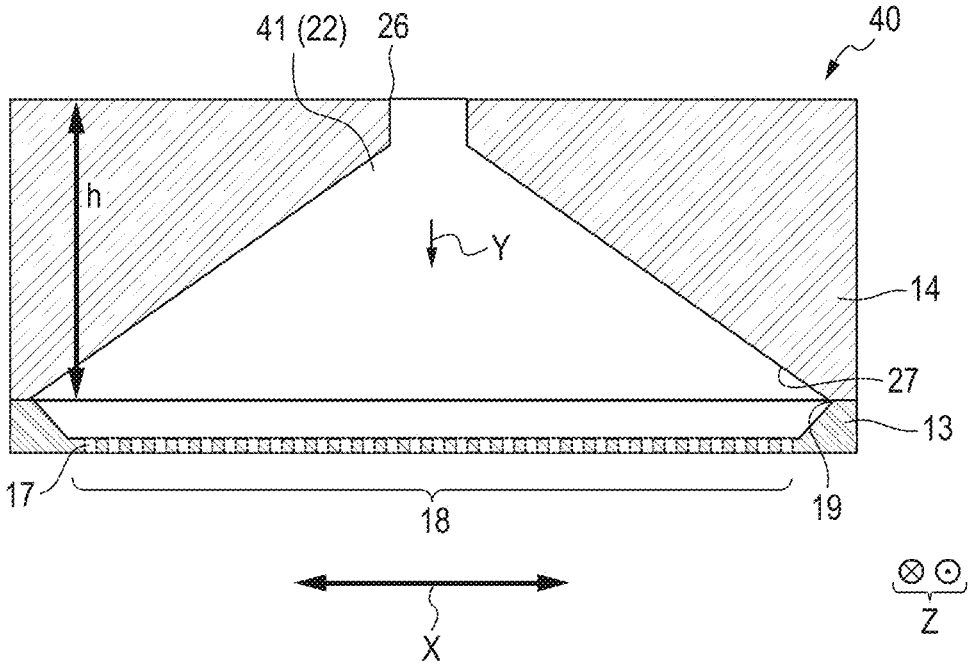
FIG. 9 is a cross-sectional view of a liquid ejection head according to Comparative Example 3.

FIG. 9 is a cross-sectional view of a liquid ejection head according to Comparative Example 3 at a plane that intersects with the scanning direction Z (see FIGS. 1A to 1C). Note that the flow path member 15 and the cartridge 16 are omitted from the illustration in FIG. 9. In a liquid ejection head 40 illustrated in FIG. 9, the first flow path 22 includes a single channel 41 for a single ejection orifice row 18. Further, a thickness h (dimension in the flow direction Y) of the support member 14 is thicker than the thickness of the support member 14 according to Comparative Examples 1 and 2. According to the liquid ejection head 40 of Comparative Example 3, the outlet 27 is expanded without increasing the size of the inlet 26 and the angle θ of the channel 41.

However, in the liquid ejection head 40, an increase in manufacturing cost that is caused by an increase in the thickness of the support member 14 is a problem. More specifically, the support member 14 is a component that supports the element substrate 13, and it is necessary to manufacture the support member 14 with a relatively high degree of dimensional accuracy. An increase in the thickness of the support member 14 results in a decrease in the formability of the support member 14, and therefore more expensive manufacturing equipment is required and the manufacturing man-hours that are required to manufacture the support member 14 increase. As a result, the manufacturing cost of the liquid ejection head 40 increases. In addition, the volume of the first flow path 22 increases accompanying the increase in the thickness of the support member 14. Consequently, more time is required for the first flow path 22 to be filled with liquid, and the amount of waste ink increases.

The problems that arise in Comparative Examples 1 to 3, namely, an increase in the amount of waste ink when filling liquid, an increase in the manufacturing cost of the liquid ejection head, and a decrease in the sealing properties between the support member 14 and the flow path member 15 are not liable to arise in the case of the liquid ejection head 12 (see FIGS. 2 to 5) according to the present invention. Accordingly, the present invention is superior to Comparative Examples 1 to 3 in terms of function, cost and reliability.

(Fifth Embodiment)

Next, a fifth embodiment of the present invention will be described using FIG. 10. In the respective embodiments described above, structures are described in which wall surfaces of the respective flow paths are inclined faces that are inclined at an angle θ. However, the present invention is not limited thereto, and is also applicable to a form that is illustrated in FIG. 10.

Figure 10:
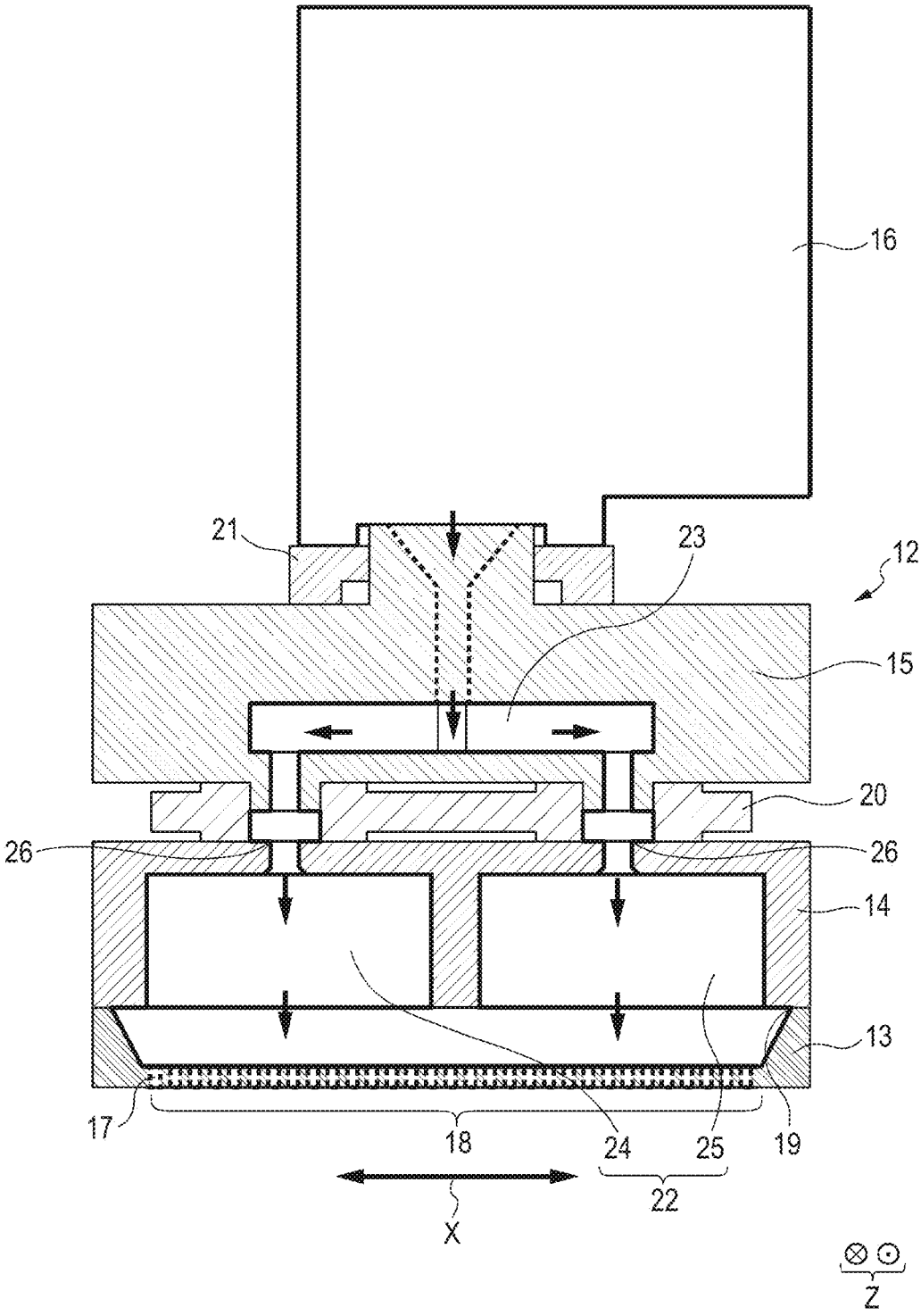
FIG. 10 is a cross-sectional view of a liquid ejection head according to a fifth embodiment.

FIG. 10 is a cross-sectional view of the liquid ejection head 12 at a plane that intersects with the scanning direction Z (see FIGS. 1A to 1C). Black arrows illustrated in FIG. 10 indicate the flow of a liquid that is supplied from the cartridge 16 to the ejection orifices 17. Hereunder, portions that are different to the structure of the first embodiment will be described in detail, and portions regarding which there is no particular description hereunder are taken to be in accordance with the structure of the first embodiment.

As illustrated in FIG. 10, the first flow path 22 is formed in the support member 14 and includes the plurality of channels 24 and 25. The ceiling surface of the flow path in the respective channels 24 and 25 is not an inclined face, and includes a face arranged along a contact surface between the support member 14 and the element substrate 13. In this structure also, even if the element substrate is lengthened in the X direction, since the liquid ejection head 12 has a plurality of connection ports 26 and also a plurality of channels, the length of the wall surface of a ceiling portion in each channel (flow path) can be made relatively short. Hence, in comparison to a case where there is a single connection port and a single flow path, the occurrence of a state in which air bubbles stagnate in the flow path in the support member can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-034146, filed Feb. 25, 2014, which is hereby incorporated by reference herein in its entirety.

What is claimed is:

1. A liquid ejection head, comprising:

an element substrate including an ejection orifice row comprising a plurality of ejection orifices, and a supply port for supplying a liquid to the ejection orifices; and a support member comprising a first flow path for supplying a liquid from a liquid supply source to the supply port, wherein:

the first flow path includes a plurality of channels for supplying a liquid to the supply port, the plurality of channels aligned in an arrangement direction in which the plurality of ejection orifices of the ejection orifice row are aligned, and at least one of the plurality of channels has a shape in which a cross section that intersects with a flow direction of a liquid increases from an upstream side to a downstream side with respect to a direction in which the liquid is supplied.

2. The liquid ejection head according to claim 1, further comprising:

a flow path member comprising a second flow path for supplying a liquid from the liquid supply source to the first flow path, wherein the plurality of channels of the first flow path are connected to the second flow path at respectively independent connection ports.

3. The liquid ejection head according to claim 1, further comprising:

a rubber member that is disposed between the support member and the flow path member and in which a through hole is formed that allows the first flow path and the second flow path to communicate with each other;

wherein one member among the support member and the flow path member is pressed against the other member through the rubber member.

4. The liquid ejection head according to claim 1, wherein:

the first flow path further comprises a common channel that allows the plurality of channels to communicate with each other; and the common channel communicates with the supply port.

5. The liquid ejection head according to claim 1, wherein, in at least one of the plurality of channels, a first angle with respect to the flow direction of a wall surface that is located at an end side of the ejection orifice row is smaller than a second angle with respect to the flow direction of a wall surface that is located at a center side of the ejection orifice row.

6. The liquid ejection head according to claim 1, wherein the liquid ejection head is a thermal-type liquid ejection head.

7. A liquid ejection head, comprising:

an element substrate comprising a plurality of elements that generate energy that is utilized for ejecting a liquid, and a supply port for supplying a liquid to the plurality of elements; and a support member comprising a first face that supports the element substrate, wherein the support member comprises a second face that is a rear face of the first face and in which are formed a first and a second opening that are arranged along a direction in which a plurality of the elements are arrayed, a first channel for supplying a liquid from the first opening to the supply port, and a second channel for supplying a liquid from the second opening to the supply port, in which an opening on the first face side of at least one channel among the first and second channels is larger than an opening on the second face side.

8. The liquid ejection head according to claim 7, wherein:

the support member comprises a common channel which allows the first channel and the second channel to communicate with each other, and the common channel communicates with the supply port.

* * * * *